US005435375A

United States Patent [19]

Eckert

[11] Patent Number: 5,435,375

[45] Date of Patent: Jul. 25, 1995

[54] TITANIUM COMPOSITE CASTING NOZZLE

[76] Inventor: C. Edward Eckert, 260 Lynn Ann Dr., New Kensington, Pa. 15068

[21] Appl. No.: 91,610

[22] Filed: Jul. 13, 1993

[51] Int. Cl.[6] ..... B23D 11/10

[52] U.S. Cl. ..... 164/437; 164/428; 164/431; 164/432

[58] Field of Search ..... 164/480, 481, 482, 428, 164/430, 431, 432, 434, 437, 488

[56] References Cited

U.S. PATENT DOCUMENTS

| | | | |
|---|---|---|---|
| 3,774,670 | 12/1973 | Gyöngyös | 164/279 |
| 3,799,410 | 3/1974 | Blossey et al. | 222/566 |
| 4,153,101 | 5/1979 | Chateau et al. | 164/428 |
| 4,339,508 | 7/1982 | Tsuya | 164/437 |
| 4,485,835 | 12/1984 | Huber et al. | 164/430 |
| 4,526,223 | 7/1985 | Ai et al. | 164/428 |
| 4,527,612 | 7/1985 | Yu et al. | 164/428 |
| 4,550,766 | 11/1985 | Ai et al. | 164/428 |
| 4,550,767 | 11/1985 | Yu et al. | 164/428 |
| 4,798,315 | 1/1989 | Lauener | 222/591 |
| 5,164,097 | 11/1992 | Wang et al. | 222/590 |

OTHER PUBLICATIONS

Metals Handbook, Desktop Ed., ASM, 1985 pp. 1-51;52, 9-2.

W. D. Kingrey et al., Intro. to Ceramics, (2nd ed) John Wiley & Sons, Pub., 1976, pp. 595, 616.

Metals Handbook, 9th ed., vol. 5, ASM 1982, p. 539.

*Primary Examiner*—Kuang Y. Lin

*Attorney, Agent, or Firm*—Andrew Alexander

[57] ABSTRACT

Disclosed is an improved casting tip for a continuous caster, the tip designed for transferring molten metal from a molten reservoir to a continuously advancing mold for casting the molten metal, the tip comprising a top wall, a bottom wall and two side walls joined to the top wall and bottom wall to form a passage therebetween having inside surfaces exposed to molten metal passing from the reservoir to the mold, the tip fabricated from a composite material comprised of a base layer of a titanium alloy and a refractory layer bonded to the base layer, the refractory layer resistant to attack by the molten metal.

16 Claims, 6 Drawing Sheets

TITANIUM COMPOSITE CASTING NOZZLE

BACKGROUND OF THE INVENTION

This invention relates to casting of molten metal into solid forms such as sheet, plate, bar or ingot, and more particularly, this invention relates to improved nozzles or tips for supplying molten metal to casters such as wheel, roll, belt or block casters.

For purposes of supplying molten metal, e.g. aluminum, to a continuous caster, for example, a roll caster, a casting nozzle is used having a tip which extends into the casting rolls. Such tips are shown, for example, in U.S. Pat. Nos. 3,774,670; 4,526,223; 4,527,612; 4,550,766 and 4,798,315.

Casting nozzles have been fabricated from various refractory materials. For example, U.S. Pat. No. 4,485,835 discloses that the part of the nozzle coming in contact with the molten metal is a refractory material comprised of silica, asbestos, sodium silicate and lime, which material is available under the trade names Marinite and Marimet. Further, U.S. Pat. No. 4,485,835 discloses that while the refractory nozzle exhibits good thermal insulation and low heat capacity, it is not very homogeneous in terms of chemical composition and mechanical properties. In addition, it adsorbs moisture and is subject to embrittlement or low mechanical strength upon preheating to operating temperature which allows such nozzles to be used only once. Further, such materials frequently outgas and experience cracking upon heating, both of which are undesirable characteristics for successful caster nozzle performance.

Refractory materials used to fabricate the casting nozzles have not been satisfactory for other reasons. For example, often the refractory material is reactive or subject to erosion or dissolution by the molten metal, e.g., aluminum, being cast, and this results in particles of refractory or reaction products ending up in the cast product.

Another problem with refractory material is that it often cannot maintain the proper strength level under operating conditions. This can result in sag or change in its dimensions which adversely affects or changes the flow of molten metal to the casting mold. That is, the flow of molten metal across the tip of the nozzle does not remain uniform. This can change the freeze front, and thus, properties can change across the width of the product. Or, change of the internal dimensions of the nozzle can result in metal flow disturbances and surface defects on the resulting sheet or plate such as eddy currents, turbulence or otherwise non-uniform flow through the nozzle.

Yet another problem with refractory-type nozzles is that often they are not reusable. That is, after molten metal has been passed once through the nozzle and the caster has been shut down, the nozzle is not reusable. Thus, a new nozzle, even if it has only been used for a short time cannot be used again. This greatly adds to the expense of operating the caster.

Reproducibility with respect to the dimensions of the refractory nozzles is a problem. For example, some nozzles may be found to work acceptably and others have been found to work unacceptably because tolerances are difficult to maintain. This leads to a very high rejection rate for nozzles, which again adds greatly to the cost of operating the caster.

Before molten metal is poured into the nozzle, it is preferred to heat the nozzle to minimize warpage and to avoid prematurely cooling the molten metal. However, with refractory materials, it is difficult to heat the nozzle uniformly.

To minimize sagging experienced with nozzles, the above-noted U.S. Pat. Nos. 4,526,223; 4,527,612; 4,550,766 and 4,550,767 disclose the use of spacers. U.S. Pat. No. 4,153,101 discloses a nozzle having a lower plate and an upper plate separated by cross pieces. Outside of the nozzle is an extension on either side of the nozzle referred to as a cheek which is divergent. U.S. Pat. No. 3,799,410 discloses the use of baffles to control the flow of molten metal to a casting machine. U.S. Pat. No. 5,164,097 discloses the use of a solid titanium liner in a crucible and nozzle for casting molten titanium.

Traditionally metals have not been used for nozzles or containers and the like because molten metal, such as molten aluminum, can dissolve the metal. In addition, most metals do not have the desirable combination of low thermal conductivity and low thermal expansion coefficients necessary for use in certain applications with molten metal. Refractory materials have not been used because they are subject to thermal shock, have low strength, are brittle and have low toughness, all of which are necessary for applications such as nozzles.

Another common problem experienced in the casting of molten aluminum is the formation of intermetallic precipitates. For example, aluminum carbide can form on the nozzle substrate material. Thus, it is desirable to utilize a substrate material that does not promote precipitation of intermetallic compounds and to use a nozzle design that discourages plugging due to precipitation of such compounds.

From the above, it will be seen that there is a great need for a nozzle which solves these problems and permits continued use or permits cleaning for continued use. The present invention provides such a nozzle which can be fabricated for use with any type of caster, including wheel, roll, block or belt casters.

SUMMARY OF THE INVENTION

It is an object of the present invention to provide an improved casting tip for a casting operation.

It is another object of the present invention to provide an improved casting tip for a wheel, roll, block or belt caster.

Yet, it is another object of the present invention to provide an improved casting tip for a continuous caster which can be resistively preheated before introducing molten metal thereto.

And yet it is another object of the invention to provide a metal caster tip having a thermal conductivity of less than 30 BTU/ft$^2$/hr/°F. and having a thermal expansion coefficient of less than $15\times10^{-6}$ in/in/°F.

A further object of the invention is to provide a caster tip design that provides uniform flow across the direction of flow to avoid non-uniform freezing and surface defects.

And a further object of the invention is to provide a caster tip design which employs molten metal flow controllers to ensure uniform flow across the direction of flow of molten metal through said tip.

It is a further object of the invention to provide a novel material resistant to erosion or dissolution by molten metals such as molten aluminum, the material having low thermal conductivity and low thermal expansion.

These and other objects will become apparent from the specification, drawings and claims appended hereto.

In accordance with these objects, there is disclosed an improved casting tip for a continuous caster, the tip designed for transferring molten metal from a molten reservoir to a continuously advancing mold for casting the molten metal, the tip comprising a top wall, a bottom wall and two side walls joined to the top wall and bottom wall to form a passage therebetween having inside surfaces exposed to molten metal passing from the reservoir to the mold, the tip fabricated from a composite material comprised of a base layer of a titanium alloy and a refractory layer bonded to the base layer, the refractory layer resistant to attack by the molten metal.

DETAILED DESCRIPTION OF THE PREFERRED EMBODIMENTS

Figure 1:
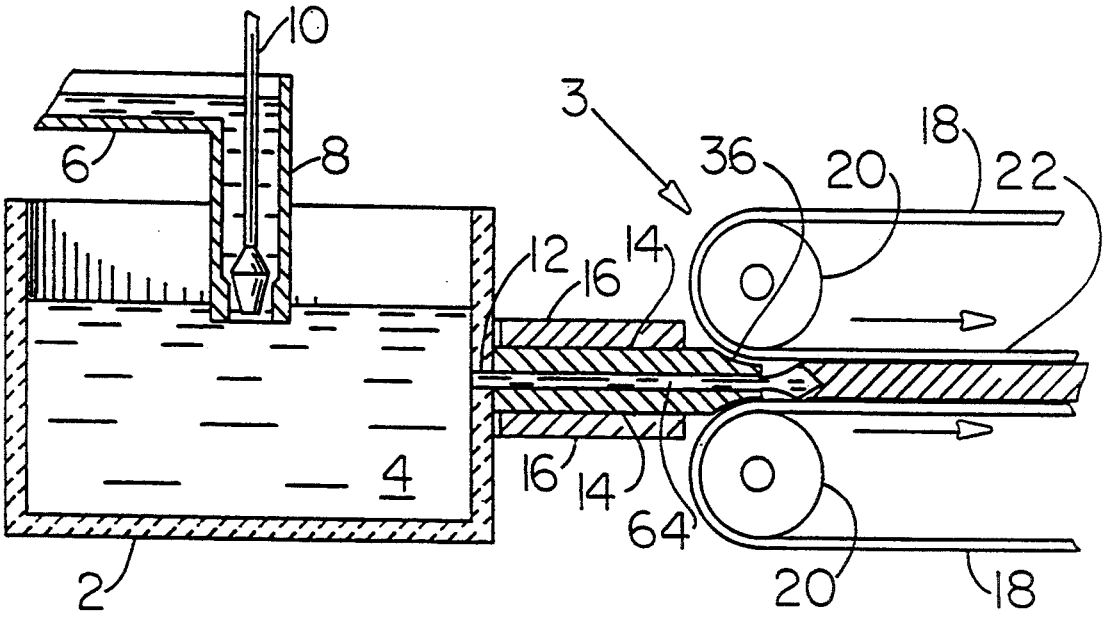
FIG. 1 is a cross section through a schematic of a molten reservoir or tundish, nozzle tip and belt caster which provides a continuously advancing mold.

Referring now to FIG. 1, there is shown a schematic of a belt casting apparatus 3 for casting molten metal including reservoir or tundish 2 for molten metal 4 which is introduced through conduit 6 and metered through downspout 8 using control rod 10. Molten metal is introduced through opening 12 in reservoir 2 to nozzle tip 14 held in place by clamps 16. Molten metal passes through nozzle tip 14 to revolving belts 18 which form a continuously advancing mold with revolving end dams (not shown) at both edges of belts 18. Belts 18 are turned by rolls 20, and molten metal is solidified between belts 18 which may be chilled to form a solid 22 such as a sheet, slab or ingot.

Figure 2:
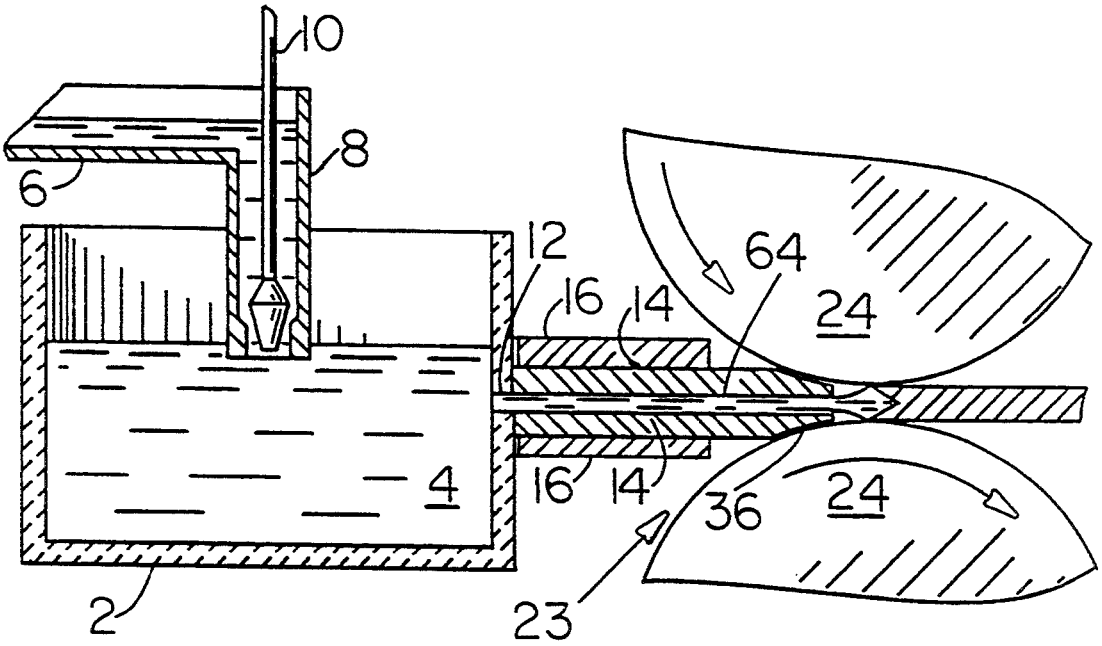
FIG. 2 is a cross section through a schematic of a molten reservoir or tundish, nozzle tip and roll caster illustrating the advancing mold.

With respect to FIG. 2, there is shown another casting apparatus 23 referred to as a roll caster including rolls 24 which rotate as shown to provide said continuously advancing mold. That is, as noted with respect to belt caster 3, there is provided a tundish 2 containing molten metal 4, and an inlet 6 which transfers or meters molten metal to tundish 2 through downspout 8 using control rod 10. A nozzle assembly, which includes nozzle tip 14 and clamps 16, transfers molten metal through opening 12 and tip 14 to the continuously advancing mold defined by rolls 24. The rolls may be chilled to aid in solidification of molten metal 4 to form solid 22 which may be in sheet, slab or ingot form.

Figure 3:
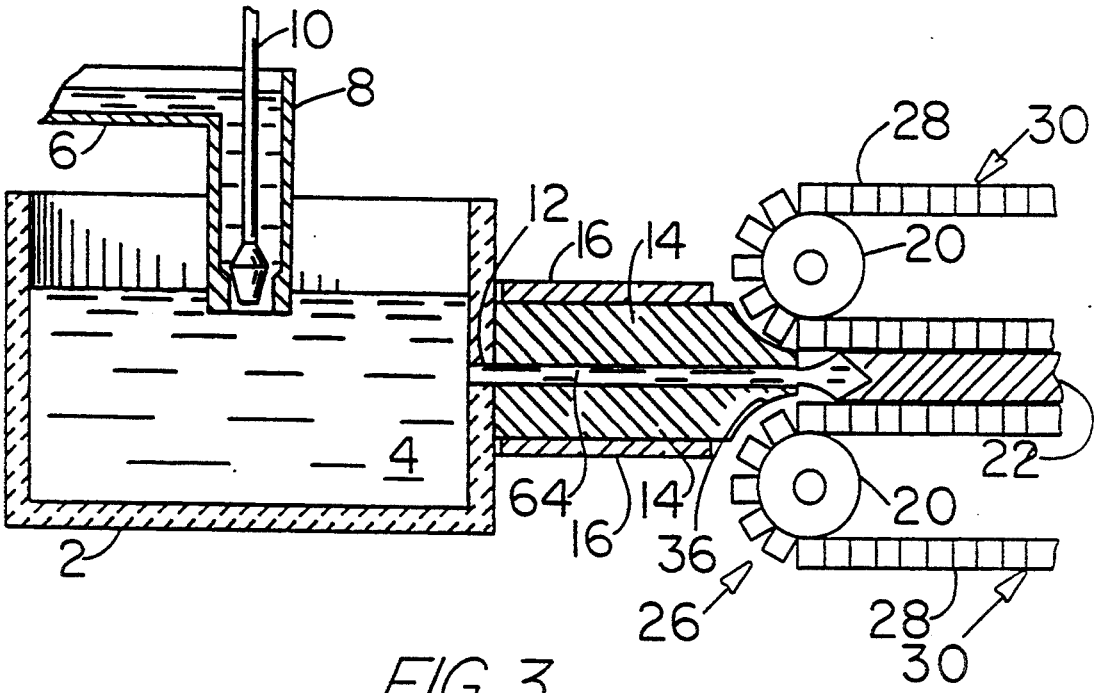
FIG. 3 is a cross section through a schematic of a molten reservoir or tundish, nozzle tip and block caster illustrating the advancing mold.

In FIG. 3 is shown another schematic of a casting apparatus 26 in the form of belts 30 formed by blocks 28 which are connected to form said belts and often referred to as a block caster. As described with respect to the belt caster and roll caster, there is provided a tundish or reservoir 2 containing molten metal 4 which is metered to the tundish along conduit 6 and along downspout 8. The molten metal passes through opening 12 and through the nozzle assembly including tip 14 and tip clamps 16. Block belts 30 and end dams (not shown) provide a continuously advancing mold therebetween as the belts are turned by rolls 20 wherein the molten metal is contained until solidification occurs to provide a solid 22 in the form of slab, ingot or sheet. The block belts may be chilled to facilitate solidification of the metal.

Figure 16:
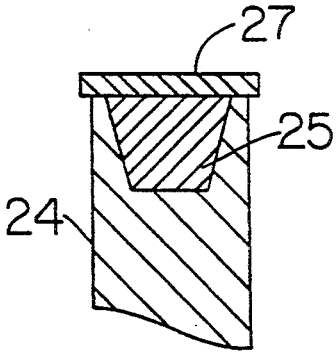
FIG. 16 is a cross section of the wheel caster of FIG. 15.
Figure 15:
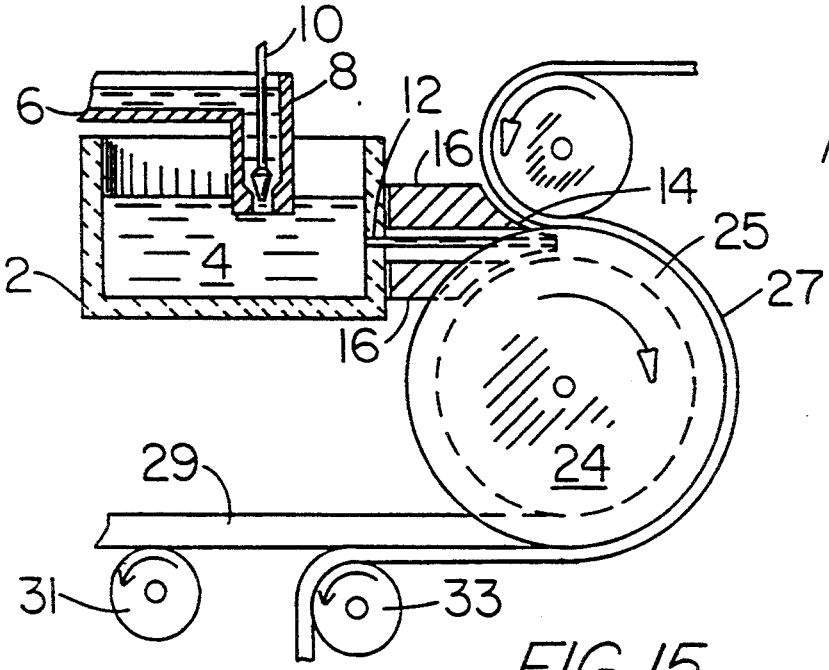
FIG. 15 is a cross section through a schematic of a molten reservoir or tundish, nozzle tip and a wheel caster and belt which provides a continuously advancing mold.

In FIGS. 15 and 16 there is shown yet another continuous caster referred to as a wheel caster which comprises a tundish 2 containing molten metal 4 which is introduced through conduit 6 and metered through downspout 8 using control rod 10. Molten metal is introduced through opening 12 in tundish 2 to nozzle 14 held in place by clamps 16. Molten metal passes through nozzle 14 into trough-shaped hollow 25 of wheel 24 where the molten metal is held in place by belt 27 until it solidifies by internal cooling, for example. Solidified metal passes over roller 31, and belt 27 is separated therefrom at roller 33. It will be appreciated that the nozzle may be used for other casting operations such as other continuous casting operations wherein molten metal is introduced to a mold such as a four-sided mold and withdrawn therefrom in solidified form.

Nozzle or tip 14 provides a stream of molten metal to the continuously advancing mold. Tip 14 can have an exit opening width 32 (FIGS. 4 and 7) which can range from 3 or 4 inches to 72 inches, depending on the width of the continuously advancing mold and whether several openings are used. Further, tip 14 can have an exit opening height 34 which can range from about ¼ inch to about 1 inch, depending on the application. For purposes of casting quality products free of surface defects, for example, the flow rate of molten metal from the exit entrance of tip 14 along with molten metal temperature must be uniform. That is, flow in tip 14 should be substantially free of molten metal recirculation, detention (sometimes referred to as HelmHolz flow) or boundary layer separation or thick laminar boundaries. It is believed that boundary layer separation or recirculation, detention of molten metal in nozzle tip 14, particularly adjacent nozzle exit 36, can lead to surface defects such as streaking on the surface of the slab or other products produced, particularly in the case of aluminum alloys.

Figure 9:
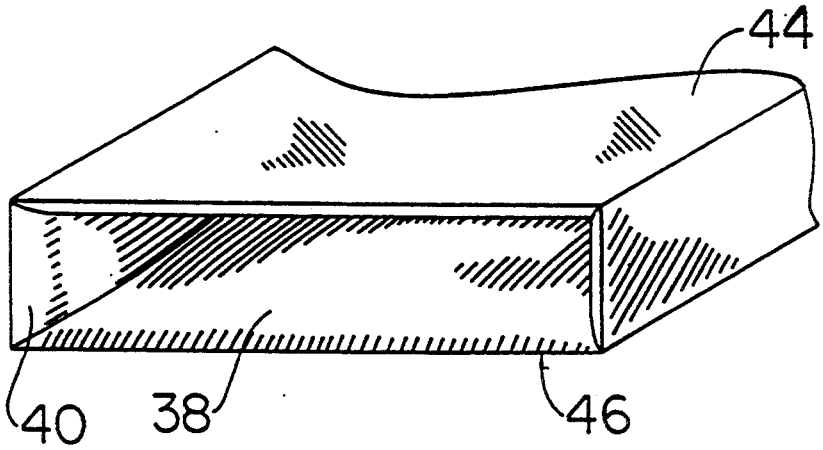
FIG. 9 shows the converging entrance into the nozzle tip.
Figure 10:
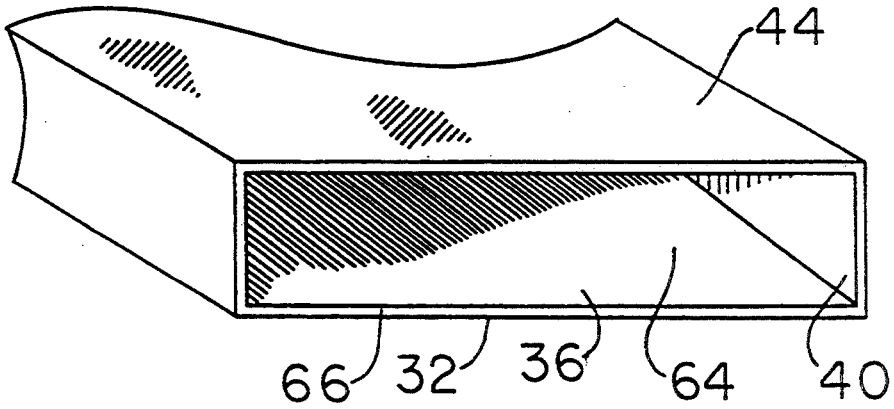
FIG. 10 shows the exit end of the nozzle tip.

In accordance with the invention, there is provided a tip 14 shown (FIG. 4) which has sidewalls 40 which first have a converging portion 42 and then have a diverging portion 43. Converging portion 42 starts at entrance 38 of the tip, as seen by metal 4 entering the tip from the tundish (FIG. 9). Diverging portion 43 ends at exit 36 of the tip (FIG. 10). There can be a straight portion (not shown) joining converging portion 42 and diverging portion 43 with the provision that the transition between said portion be made smoothly and without points or protuberances which would cause molten metal recirculation or wakes and subsequent surface defects on the solidified product. In a preferred embodiment, converging portion 42 connects to diverging portion 43 with a smooth transition at the point where these portions join. Further, it is preferred that converging portion 42 be defined by an arc section starting at entrance end 38 and ending at the beginning of diverging portion 43. Further, it is preferred that diverging portion 43 of sidewalls 40 be defined by a straight line from the end of the converging portion to exit end 36. A smooth transition is obtained if diverging portion 43 connects converging arc portion 42 so as to make a right angle with the radius of the arc defining converging portion 42. When sidewall diverging portion 43 is substantially straight, the angle of divergence is in the range of about 0.1° to 10°, with a preferred range being 1° to 7°, with a typical angle being about 1° to 4°. Further, it is preferred that sidewalls 40 converge and diverge about equal amounts from a centerline of the tip. That is, the oppositely-disposed sidewall is preferred to be a mirror image of the other sidewall.

Figure 4:
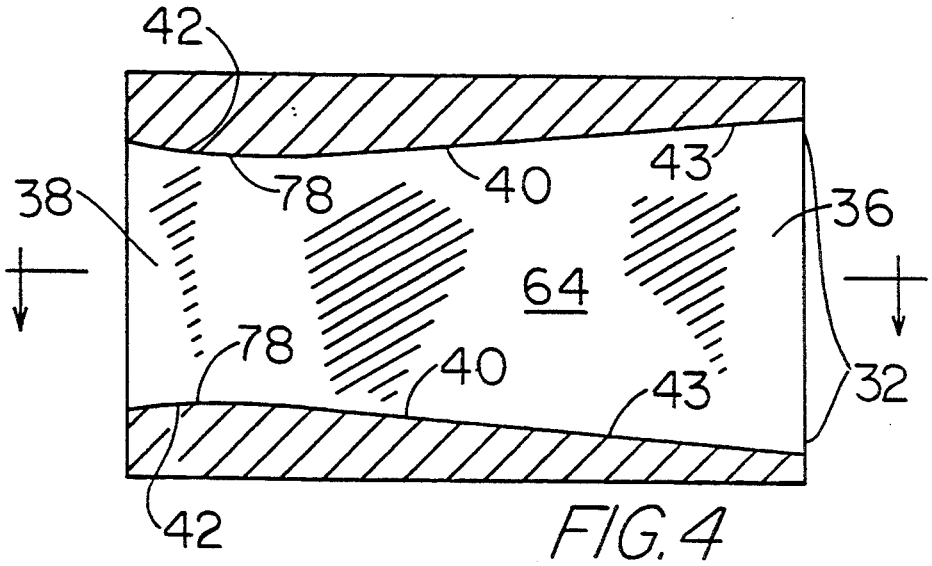
FIG. 4 is a top view of a nozzle tip of the invention showing converging/diverging sidewalls with respect to a centerline.
Figure 13:
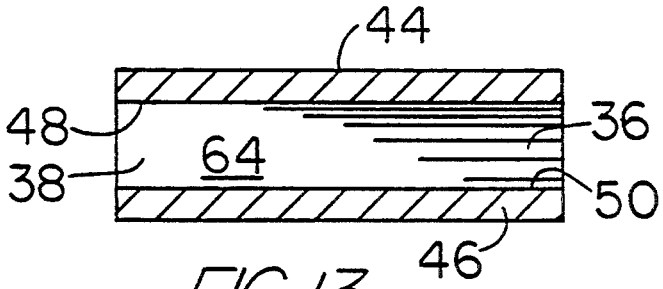
FIG. 13 is a cross sectional view showing top and bottom walls of the tip being generally parallel.

In the embodiment shown in FIG. 4, inside surface 48 of top wall 44 and inside surface 50 of bottom wall 46 (FIG. 13) can be substantially flat from entrance 38 to exit 36.

In a preferred embodiment, inside surface 52 of top wall 44 and inside surface 54 of bottom wall 46 (FIG. 5) first converge from tip entrance 38 and diverge to exit 36. Thus, top wall inside surface 52 has a converging portion 56 and an inside surface diverging portion 60. Similarly, bottom wall inside surface 54 has a converging portion 58 and a diverging portion 62. As with sidewalls 40, converging portions 56 and 58 connect to diverging portions 60 and 62 with a smooth transition at the point where these portions join. Further, it is preferred that converging portions 56 and 58 be defined by an arc section starting at entrance end 38 and ending at the beginning of diverging portions 60 and 62. Further, it is preferred that diverging portions 60 and 62 of top and bottom walls 44 and 46 be defined by a straight line from the end of the converging portion to exit end 36. A smooth transition zone is obtained if diverging portions 60 and 62 connect converging arc portions 56 and 58 so as to make a right angle with the radius of the arc converging arc portions 56 and 58. When top and bottom walls diverging portions 60 and 62 are substantially straight, the angle of divergence is in the range of about 0.1° to 10°, with a preferred range being 1° to 7°, with a typical angle being about 1° to 4°. Further, it is preferred that inside surfaces of top and bottom walls 52 and 54 converge and diverge about equal amounts from a centerline of the tip. That is, the oppositely disposed top and bottom walls are preferred to be mirror images of the other. Top and bottom walls 44 and 46, illustrated in FIG. 5, can be used with sidewalls 40 when sidewalls 40 do not converge or diverge and are substantially flat or straight from entrance 38 to exit 36.

When width 32 of exit 36 is relatively narrow, e.g., 3 or 4 inches, then several tips may be joined together to provide the desired width. Or, a nozzle tip may be fabricated wherein several passages are provided as shown in FIG. 6. Sidewalls 66 of multiple passage nozzle tip 71 are provided in converging/diverging relationship, as described with respect to FIG. 4. Further, top wall 44 and bottom wall 46 of each passage in multiple passage nozzle 71 of FIG. 6 can be substantially parallel, as noted with respect to FIG. 13. Preferably, top and bottom walls converge and diverge, as described with respect to FIG. 5. Sufficient passages may be added as desired.

In order to maintain a uniform molten metal velocity and uniform thermal profile across the direction of flow of the band or ribbon of molten metals leaving nozzle tip exit 36, molten metal flow stabilizers or energizers 70 may be provided in molten flow path through tip 14. Molten metal flow stabilizers or controllers 70 have the effect of aiding in achieving the uniform molten metal velocity and thermal profile in the ribbon of molten metal leaving exit 36 by providing mixing and homogenizing molten flow within slot 64 by minimizing, reducing or even avoiding molten metal recirculation or detrimental thick laminar boundary effects within slot 64.

Figure 7:
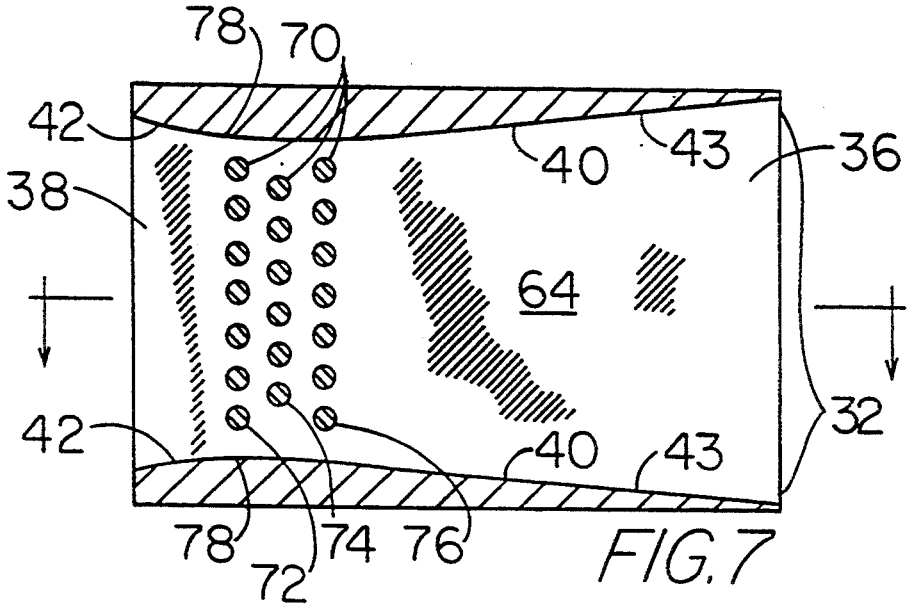
FIG. 7 is a top view of the nozzle tip similar to FIG. 4 showing rows of cylindrical columns of molten metal flow controllers.

The molten metal flow controllers 70 preferably have a circular column configuration, as shown in FIG. 7, where rows 72, 74 and 76 and circular columns 70 are shown for illustration purposes. It will be appreciated that the number of columns and the number of rows can vary, depending to some extent on the nozzle tip configuration and the viscosity of the molten metal. For example, for molten aluminum, three rows have been found to be suitable. The rows can also be varied, depending on the velocity of molten metal through slot 64.

Figure 8:
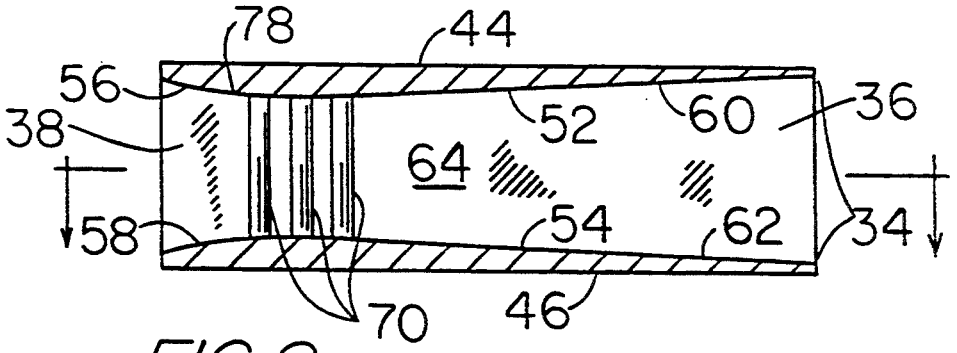
FIG. 8 is a view similar to FIG. 5 along the centerline of FIG. 7 showing rows of cylindrical columns of molten metal flow controllers.

Location of flow stabilizers 70 within slot 64 is important. Thus, it is preferred that first row 72 of stabilizers 70 be positioned at or after the apex or transition zone 78 between converging and diverging portions. The number of columns 70 can be varied across the width of slot 64, depending to some extent on the diameter of the columns used. Preferably, 1 to 6 columns are used for every inch of width of slot 64. For example, if slot width 32 was 16 inches, then 32 columns can be used in row 72. Circular columns 70 can have a diameter ranging from 1/16 to ¾ inch in diameter, and preferably ⅛ to ½ inch in diameter, with a typical column diameter being about ⅜ inch. Further, preferably, when multiple rows of columns are used, for example, three rows, as shown in FIG. 7, it is preferred that third row 76 have a larger diameter than rows 72 and 74. For example, column diameter in row 78 can be 20 to 125% greater than the diameter of columns in rows 72 and 74. Further, it is preferred that the bank or rows of flow stabilizers or controllers be located more than half way back from tip exit 36. When multiple rows are utilized, as shown in FIGS. 7 and 8, it is preferred that circular columns 70 in second row 74 are positioned half way between column centers in first row 72. Further, it is preferred that circular columns 70 in third row 76 be placed half way between column centers in second row 74. The same arrangement should be applied to additional rows.

The rows of energizers or stabilizers have the effect of controlling the flow of molten metal through slot 64 by maximizing uniformity of flow velocity and thermal profile across the width of the tip. Thus, the velocity at any random section across the width at exit 36 would be substantially the same as any other random section taken at exit 36.

Figure 5:
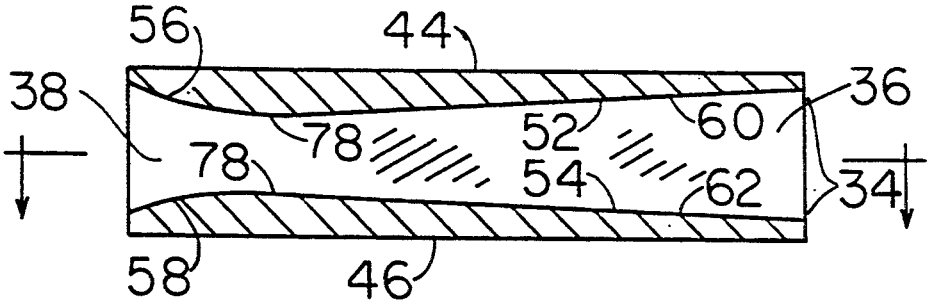
FIG. 5 is a cross-sectional view along the centerline of FIG. 4 showing converging/diverging top and bottom walls.
Figure 6:
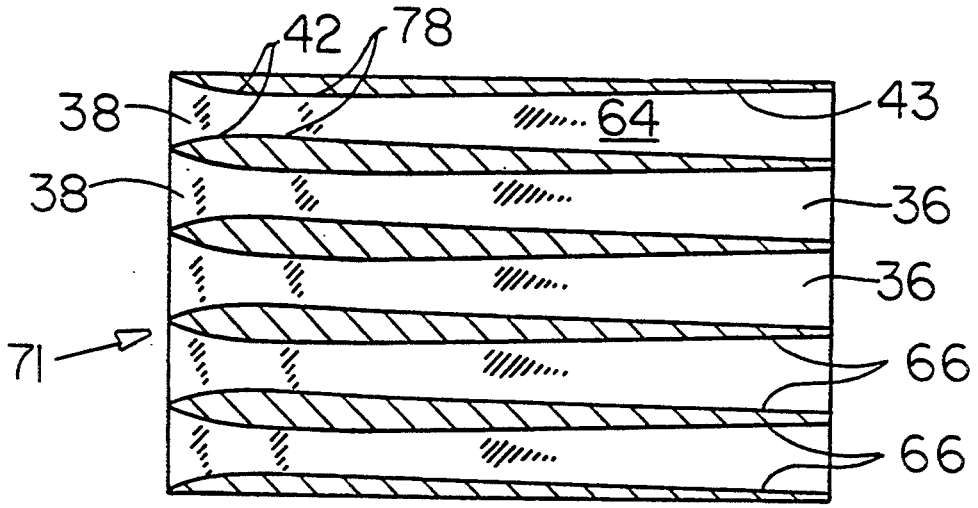
FIG. 6 is a top view of the nozzle tip similar to FIG. 4 showing a number of said nozzle tips side by side.

Molten metal flow controllers 70 may be used in conjunction with a nozzle or tip having converging-/diverging top and bottom walls, as shown in FIG. 5, and wherein the tip has sides which are substantially straight sides, which preferably are diverging. In addition, molten metal flow controllers 70 may be used in conjunction with converging/diverging sidewalls 40, as shown in FIG. 4, and wherein the top and bottom walls are substantially straight but preferably are diverging after flow controllers 70. However, in a preferred embodiment, molten metal flow stabilizers 70 are used in conjunction with both converging/diverging sidewalls and top and bottom walls, in accordance with the invention. Providing uniform velocity and thermal profile utilizing the molten metal flow controllers has the advantage of producing slab stock, particularly aluminum slab stock substantially free of surface streaking or surface defects.

The novel nozzle or tip designs of the present invention may be fabricated out of any refractory board material such as the Marinite or Marimet referred to earlier because the subject design alleviates some of the problems attendant the use of such material. However, the preferred material for fabrication of nozzle tip 14 is a metal or metalloid material suitable for contacting molten metal and which material is resistant to dissolution or erosion by the molten metal. A metal or metalloid coated with a material such as a refractory resistant to attack by molten metal is suitable for forming into the novel nozzle. In addition, a suitable material has a room temperature yield strength of at least 10 ksi and preferably in excess of 25 ksi.

Further, the material of construction should have a thermal conductivity of less than 30 BTU/ft$^2$/hr/°F., and preferably less than 15 BTU/ft$^2$/hr/°F., with a most preferred material having a thermal conductivity of less than 10 BTU/ft$^2$/hr/°F. Another important feature of a desirable nozzle is thermal expansion. Thermal expansion is important to maintain dimensional stability and tolerances when the tip is positioned with respect to the continuously advancing mold. Thus, a suitable material should have a thermal expansion coefficient of less than $15\times10-6$ in/in/°F., with a preferred thermal expansion coefficient being less than $10\times10^{-6}$ in-/in/°F., and the most preferred being less than $5\times10^{-6}$ in/in/°F. Another important feature of the material useful in the present invention is chilling power. Chilling power is important, for example, when the material is used in a nozzle to prevent the molten metal from freezing at the start of a cast. Chilling power is defined as the product of heat capacity, thermal conductivity and density. Thus, preferably the material in accordance with the invention has a chilling power of less than 500, preferably less than 400 and typically in the range of 100 to 360 BTU$^2$/ft$^4$ hr °F. Further, preferably, the material is capable of being heated by direct resistance or by passage of an electrical current through the material. Additionally, it is preferred that the material does not give off gases when subjected to operating temperatures. In addition, it is important that the material not permit growth or build-up of intermetallic compounds, for example, at nozzle exit edge 66. Further, it is important that the inside surfaces are smooth and free of porosity. For purposes of re-using, it is preferred that the tip can be cleaned to remove residual solidified metal.

The preferred material for fabricating into nozzles is a titanium base alloy having a thermal conductivity of less than 30 BTU/ft$^2$/hr/°F., preferably less than 15 BTU/ft$^2$/hr/°F., and typically less than 10 BTU/ft$^2$/hr/°F., and having a thermal expansion coefficient less than $15\times10^{-6}$ in/in/°F., preferably less than $10\times10^{-6}$ in/in/°F., and typically less than $5\times10^{-6}$ in/in/°F.

When the molten metal being cast is lead, for example, the titanium base alloy need not be coated to protect it from dissolution. For other metals, such as aluminum, copper, steel, zinc and magnesium, refractory-type coatings should be provided to protect against dissolution of the metal tip or metalloid tip by the molten metal.

The titanium alloy which can be used is one that preferably meets the thermal conductivity requirements as well as the thermal expansion coefficient noted herein. Further, typically, the titanium alloy should have a yield strength of 30 ksi or greater at room temperature, preferably 70 ksi, and typical 100 ksi. The titanium alloys useful in the present invention include CP (commercial purity) grade titanium, or alpha and beta titanium alloys or near alpha titanium alloys, or alpha-beta titanium alloys. The alpha or near-alpha alloys can comprise, by wt. %, 2 to 9 Al, 0 to 12 Sn, 0 to 4 Mo, 0 to 6 Zr, 0 to 2 V and 0 to 2 Ta, and 2.5 max. each of Ni, Nb and Si, the remainder titanium and incidental elements and impurities.

Specific alpha and near-alpha titanium alloys contain, by wt. %, about:

(a) 5 Al, 2.5 Sn, the remainder Ti and impurities.
(b) 8 Al, 1 Mo, 1 V, the remainder Ti and impurities.
(c) 6 Al, 2 Sn, 4 Zr, 2 Mo, the remainder Ti and impurities.
(d) 6 Al, 2 Nb, 1 Ta, 0.8 Mo, the remainder Ti and impurities.
(e) 2.25 Al, 11 Sn, 5 Zr, 1 Mo, the remainder Ti and impurities.
(f) 5 Al, 5 Sn, 2 Zr, 2 Mo, the remainder Ti and impurities.

The alpha-beta titanium alloys comprise, by wt. %, 2 to 10 Al, 0 to 5 Mo, 0 to 5 Sn, 0 to 5 Zr, 0 to 11 V, 0 to 5 Cr, 0 to 3 Fe, with 1 Cu max., 9 Mn max., 1 Si max., the remainder titanium, incidental elements and impurities.

Specific alpha-beta alloys contain, by wt. %, about:

(a) 6 Al, 4 V, the remainder Ti and impurities.
(b) 6 Al, 6 V, 2 Sn, the remainder Ti and impurities.
(c) 8 Mn, the remainder Ti and impurities.
(d) 7 Al, 4 Mo, the remainder Ti and impurities.
(e) 6 Al, 2 Sn, 4 Zr, 6 Mo, the remainder Ti and impurities.
(f) 5 Al, 2 Sn, 2 Zr, 4 Mo, 4 Cr, the remainder Ti and impurities.
(g) 6 Al, 2 Sn, 2 Zn, 2 Mo, 2 Cr, the remainder Ti and impurities.
(h) 10 V, 2 Fe, 3 Al, the remainder Ti and impurities.
(i) 3 Al, 2.5 V, the remainder Ti and impurities.

The beta titanium alloys comprise, by wt. %, 0 to 14 V, to 12 Cr, 0 to 4 Al, 0 to 12 Mo, 0 to 6 Zr and 0 to 3 Fe, the remainder titanium and impurities.

Specific beta titanium alloys contain, by wt. %, about:

(a) 13 V, 11 Cr, 3 Al, the remainder Ti and impurities.
(b) 8 Mo, 8 V, 2 Fe, 3 Al, the remainder Ti and impurities.
(c) 3 Al, 8 V, 6 Cr, 4 Mo, 4 Zr, the remainder Ti and impurities.
(d) 11.5 Mo, 6 Zr, 4.5 Sn, the remainder Ti and impurities.

Figure 14:
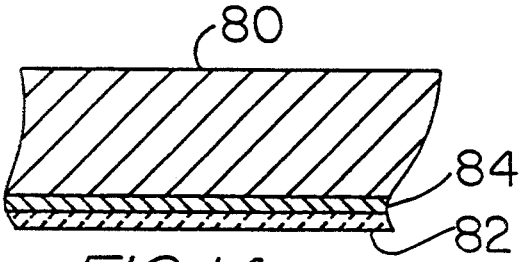
FIG. 14 is a cross-sectional view of the composite material in accordance with the invention.

When it is necessary to provide a coating to protect the nozzle tip base layer 80 (FIG. 14) of metal or metalloid from dissolution or attacked by molten metal, a refractory coating 82 is applied to protect inside surfaces of slot 64. The refractory coating can be any refractory material which provides the tip with a molten metal resistant coating, and the refractory coating can vary, depending on the molten metal being cast. Thus, a novel composite material is provided permitting use of metals or metalloids having the required thermal conductivity and thermal expansion for use with molten metal which heretofore was not deemed possible. The refractory coating may be applied both to the inside and outside of the nozzle. When coated on the outside, it aids in protection from oxidation. In addition, the refractory coating minimizes heat transfer and also can resist growth of intermetallic compounds which would interfere with flow. Further, the refractory coating minimizes skull or metal buildup on nozzle trailing edges.

Cleaning of the nozzle may be achieved by dilute acid or alkaline treatment, for example. Further, to facilitate cleaning, the nozzle of the invention can be constructed from individual parts and the parts held together with fasteners.

When the molten metal to be cast is aluminum, magnesium, zinc, or copper, etc., a refractory coating may comprise at least one of alumina, zirconia, yittria stabilized zirconia, magnesia, magnesium titanite, or mullite or a combination of alumina and titania. While the refractory coating can be used on the metal or metalloid comprising the nozzle, a bond coating 84 (FIG. 14) can be applied between the base metal and the refractory coating. The bond coating can provide for adjustments between the thermal expansion coefficient of the base metal alloy, e.g., titanium. and the refractory coating when necessary. The bond coating thus aids in minimizing cracking or spalling of the refractory coat when the nozzle is heated to the operating temperature. When the nozzle is cycled between operating temperature and room temperature, for example, when the nozzle is reused, the bond coat can be advantageous in preventing cracking, particularly if there is a considerable difference between the thermal expansion of the metal or metalloid and the refractory.

Typical bond coatings comprise Cr—Ni—Al alloys and Cr—Ni alloys, with or without precious metals. Bond coatings suitable in the present invention are available from Metco Inc., Cleveland, Ohio, under the designation 460 and 1465. In the present invention, the refractory coating should have a thermal expansion that is plus or minus five times that of the base material. Thus, the ratio of the coefficient of expansion of the base material can range from 5:1 to 1:5, preferably 1:3 to 1:1.5. The bond coating aids in compensating for differences between the base material and the refractory coating.

The bond coating has a thickness of 0.1 to 5 mils with a typical thickness being about 0.5 mil. The bond coating can be applied by sputtering, plasma or flame spraying, chemical vapor deposition, spraying or mechanical bonding by rolling, for example.

After the bond coating has been applied, the refractory coating is applied. The refractory coating may be applied by any technique which provides a uniform coating over the bond coating. The refractory coating can be applied by aerosol sputtering, plasma or flame spraying, for example. Preferably, the refractory coating has a thickness in the range of 4 to 22 mils, preferably 5 to 15 mils with a suitable thickness being about 10 mils. The refractory coating may be used without a bond coating.

Figure 11:
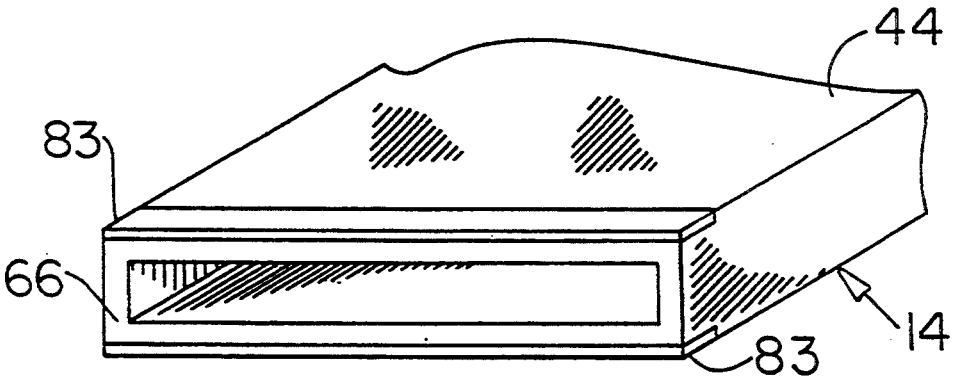
FIGS. 11 and 12 show the exit end of a metallic nozzle tip and rubbing block for preventing damage to rolls, blocks or belts of the caster.
Figure 12:
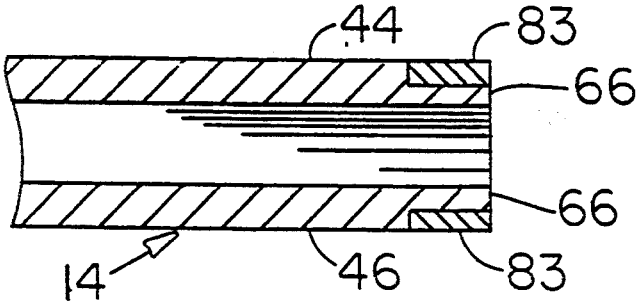

Positioning a metal nozzle such as a titanium nozzle requires care because at operating temperature, the metal nozzle tends to glow and thus adjustments with respect to the casting belts are difficult. If the metal nozzle tip touches the belts, this can adversely abrade the belt surface because of the hardness of the refractory coating and render the belt unusable. Thus, the nozzle tip must be positioned adjacent the casting belt with care. In this embodiment of the invention, wear strips 83 (FIGS. 11 and 12) can be provided on top wall 44 and bottom wall 46 substantially as shown. Wear strips 83 can be continuous (as shown) or can be divided into individual portions. Wear strips 83 can be attached to top and bottom walls 44 and 46 using fasteners. Wear strips 83 can be fabricated from board material such as Marinite, Marimet or sodium silicate bonded Kaowool or a material which will withstand the operating temperatures and yet will not abrade or damage the belts. Wear strips 84 have the advantage that they provide the caster operator with additional guidance when adjustments are being made during operation.

Prior to passing molten metal from the tundish or reservoir to nozzle 14, it is preferred to heat the nozzle or tip to a temperature close to the operating temperature. The subject invention permits the use of electrical heating. That is, metal nozzle 14 can be heated electrically by indirect resistance. Or, metal nozzle 14 can be heated by the direct passage of an electrical current through the metal. When the metal nozzle is titanium, the nozzle can be heated electrically by this method to the desired temperature before molten metal is introduced thereto.

While the invention has been described with respect to a nozzle tip for molten aluminum, for example, it will be appreciated that the composite material has application to other components such as nozzles used for melt spinning, or for containing, contacting, or handling and directing the flow of such molten metals. Handling as used herein is meant to include any use of the composite material where it comes in contact with molten aluminum, for example. Thus, containing, immersing and contacting are illustrative of the uses that may be made of the novel composite material. For example, the composite material can be used to fabricate pipes or conduits, channels or troughing for molten metal such as conduit 6. Further, downspout 8, metering rod 10 and tundish 2 can be fabricated from the composite material. In the roll caster or block caster, side dams and wheels can be fabricated from the composite material. In casting operations, headers for FDC and HDC casting units can be made from the composite material. Other parts that can be fabricated from the composite material for molten aluminum, for example, include impellers, impeller shafts, pumps, tap holes, plug rods, shot sleeves and rams for die casters, flow control devices, ladles for molten metal transfer, permanent molds, semi-permanent molds and die casting molds. The titanium alloy based (e.g., 6242) composite material is particularly useful when low chilling power is necessary, for example, when bottom blocks are used in casting ingot by EMC, FDC and DC processes.

Figure 17:
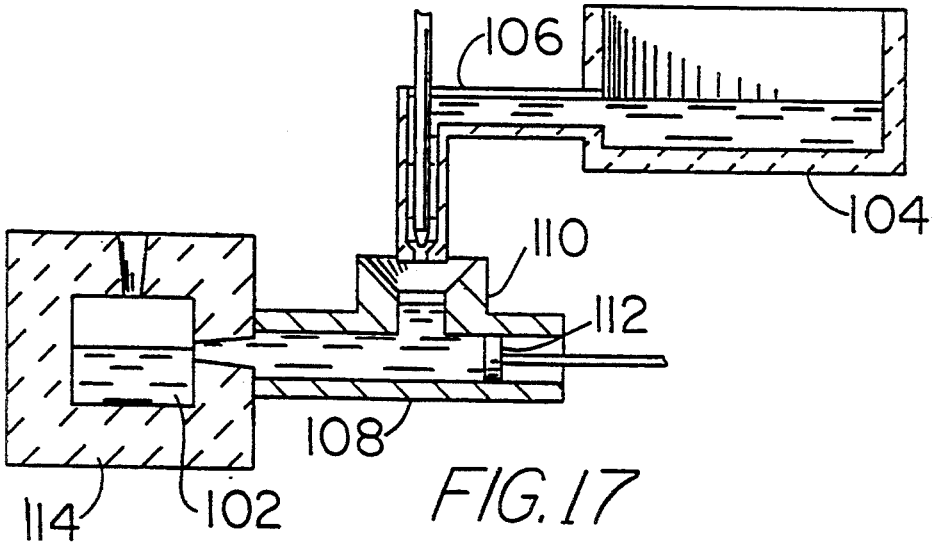
FIG. 17 shows a schematic of a shot sleeve for introducing molten metal to a die cavity.

The shot sleeve referred to is shown schematically in FIG. 17 where 102 is a die cavity and 104 is a source of molten metal such as aluminum. Molten aluminum is conveyed along conduit 106 to shot sleeve 108 which has an opening 110 to receive molten metal. Shot sleeve 108 is provided with a ram 112 that seals the shot sleeve to the die cavity 102. In operation, the shot sleeve is filled with molten metal and then the ram is moved forward towards the die. For purposes of the present invention, the walls 114 surrounding or forming die cavity 102, shot sleeve 108 and ram 112 may be fabricated from the composite material of the invention. The shot sleeve and ram are particularly suitable for fabrication from the titanium based composite material because the titanium has particularly low chilling power. Further, the shot sleeve and ram may be cleaned and reused many times. Also, the composite has high strength that permits high ram pressure.

Figure 18:
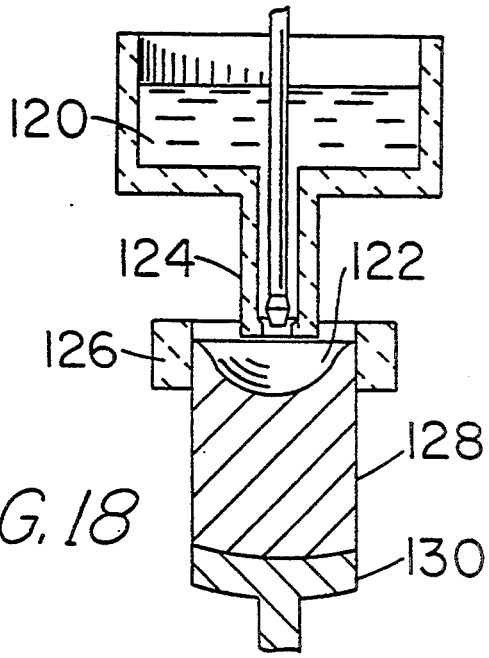
FIG. 18 shows a schematic of a bottom block and ingot being cast.
Figure 19:
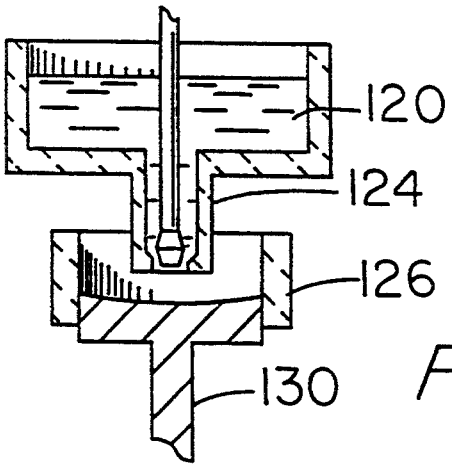
FIG. 19 shows a schematic of a bottom block closing a die cavity for the start of casting molten metal into ingot.

The bottom block referred to is illustrated in FIGS. 18 and 19 where a source of molten aluminum 120 is provided and metered to mold crater 122 through downspout 124. Molds 126 contain the molten aluminum until it is solidified into ingot 128 by liquid applied thereto. For purposes of starting to cast an ingot, bottom block 130 is moved adjacent molds 126 to contain molten aluminum until it solidifies (FIG. 19). Then, bottom block 130 is withdrawn at a rate commensurate with the rate of solidification. In the present invention, bottom block 130 can be fabricated from titanium based material and refractory coating in accordance with the invention. This obviates the need for blankets and the like that are commonly used to start ingot casting to prevent ingot butt cracking.

While the composite material comprises a titanium alloy 6242, for example, with or without a bond coat and a layer of alumina thereon particularly suitable for molten aluminum, it will be noted that other refractory coatings may be used which are particularly resistant to dissolution or attack by other molten metals. For example, alumina, magnesia, and mullite are resistant to molten copper. For molten magnesium, a refractory coating of magnesia, magnesium aluminate, alumina and titania are useful. Silica, alumina, corderite and titania are resistant to molten steel.

While the invention has been described in terms of preferred embodiments, the claims appended hereto are intended to encompass other embodiments which fall within the spirit of the invention.

What is claimed is:

1. An improved casting tip for a continuous caster, the tip designed for transferring molten metal from a molten reservoir to a continuously advancing mold for casting said molten metal, said tip comprising a top wall, a bottom wall and two side walls joined to said top wall and bottom wall to form a passage therebetween having inside surfaces exposed to molten metal passing from said reservoir to said mold, said tip fabricated frown a composite material comprised of:

(a) a base layer of a titanium alloy having a coefficient of thermal expansion of less than $15\times10^{-6}$ in/in/°F.; and (b) a refractory layer bonded to said base layer, the refractory layer resistant to attack by said molten metal, said refractory layer and said titanium alloy having a ratio of coefficient of thermal expansion in the range of 5:1 to 1:5.

2. The casting tip in accordance with claim 1 wherein the titanium alloy has a thermal conductivity of less than 30 BTU/ft$^2$/hr/°F.

3. The casting tip in accordance with claim 1 wherein the titanium alloy has a thermal conductivity of less than 15 BTU/ft$^2$/hr/°F.

4. The casting tip in accordance with claim 1 wherein the titanium alloy has a thermal expansion coefficient of less than $10\times10^{-6}$ in/in/°F. and a chilling power of less than 500 BTU$^2$/ft$^4$ hr °F.

5. The casting tip in accordance with claim 1 wherein the titanium base alloy is a titanium alloy selected from the group consisting of alpha, beta, near alpha, and alpha-beta titanium alloys having a chilling power of less than 400 BTU$^2$/ft$^4$ hr °F.

6. The casting tip in accordance with claim 1 wherein the titanium base alloy is a titanium alloy selected from one of the group consisting of 6242, 1100 and commercially pure grade titanium.

7. The casting tip in accordance with claim 1 wherein a bond coating is provided between the base layer and the refractory layer.

8. The casting tip in accordance with claim 1 wherein the refractory coating is selected from one of the group consisting of $Al_2O_3$, $ZrO_2$, $Y_2O_3$ stabilized $ZrO_2$, and $Al_2O_3$—$TiO_2$.

9. The casting tip in accordance with claim 7 wherein said bond coating has a thickness in the range of 0.1 to 5 mils.

10. The casting tip in accordance with claim 1 wherein said refractory coating has a thickness in the range of 4 to 22 mils.

11. The casting tip in accordance with claim 7 wherein said bond coating comprises an alloy selected from the group consisting of Cr—Ni—Al alloy and Cr—Ni alloy.

12. The casting tip in accordance with claim 1 wherein the protective refractory coating comprises 5 to 20 wt. % titania and the balance alumina.

13. An improved casting tip for a continuous caster, the tip designed for transferring molten metal from a molten reservoir to a continuously advancing mold for casting said molten metal, said tip comprising a top wall, a bottom wall and two side walls joined to said top wall and bottom wall to form a passage therebetween having inside surfaces exposed to molten metal passing from said reservoir to said mold, said tip fabricated from a composite material comprised of:

(a) a base layer of a titanium alloy having a coefficient of thermal expansion of less than $15\times10^{-6}$ in/in/°F.;

(b) a bond coat bonded to said inside surfaces; and (c) a refractory layer bonded to said bond coat, the refractory layer resistant to attack by said molten metal, the composite material having a thermal conductivity of less than 30 BTU/ft$^2$/hr/°F., a thermal expansion coefficient of less than $15\times10^{-6}$ in/in/°F., and a chilling power of less than 400 BTU$^2$/ft$^4$ hr °F., said refractory layer and said titanium alloy having a ratio of coefficient of thermal expansion in the range of 5:1 to 1:5.

14. An improved casting tip for a continuous caster, the tip designed for transferring molten metal from a molten reservoir to a continuously advancing mold for casting said molten metal, said tip comprising a top wall, a bottom wall and two side walls joined to said top wall and bottom wall to form a passage therebetween having inside surfaces exposed to molten metal passing from said reservoir to said mold, said tip fabricated from a composite material comprised of:

(a) a base layer of a titanium alloy selected from alpha, beta, near alpha, and alpha-beta titanium alloys having a coefficient of thermal expansion of less than $15\times10^{-6}$ in/in/°F.;

(b) a metal alloy bond coat bonded to said inside surfaces; and (c) a refractory layer bonded to said bond coat, the refractory layer resistant to attack by said molten metal, the composite material having a thermal conductivity of less than 30 BTU/ft$^2$/hr/F. and a thermal expansion coefficient of less than $15\times10^{-6}$ in/in/°F. and a chilling power of less than 400 BTU$^2$/ft$^4$ hr °F., said refractory layer and said titanium alloy having a ratio of coefficient of thermal expansion in the range of 5:1 to 1:5.

15. An improved casting tip for a continuous caster, the tip designed for transferring molten aluminum from a molten reservoir to a continuously advancing mold for casting said molten metal, said tip comprising a top wall, a bottom wall and two side walls joined to said top wall and bottom wall to form a passage therebetween having inside surfaces exposed to molten metal passing from said reservoir to said mold, said tip fabricated from a composite material comprised of:

(a) a base layer of titanium alloy 6242 having a coefficient of thermal expansion of less than $15\times10^{-6}$ in/in/°F.;

(b) a bond coat of a metal alloy selected from a Cr—Ni—Al alloy and a Cr—Ni alloy bonded to said inside surfaces; and (c) a refractory layer selected from the group of material consisting of $Al_2O_3$, $ZrO_2$, $Y_2O_3$ stabilized $ZrO_2$, and $Al_2O_3$—$TiO_2$ bonded to said bond coat, the refractory layer resistant to attack by said molten metal, the composite material having a thermal conductivity of less than 30 BTU/ft$^2$/hr/°F. and a thermal expansion coefficient of less than $15\times10^{-6}$ in/in/°F., said refractory layer and said titanium alloy having a ratio of coefficient of thermal expansion in the range of 5:1 to 1:5.

16. The casting tip in accordance with claim 15 wherein the refractory layer is $Al_2O_3$.

* * * * *